US010208370B2

(12) United States Patent
Hatta et al.

(10) Patent No.: US 10,208,370 B2
(45) **Date of Patent: *Feb. 19, 2019**

(54) HIGH-STRENGTH ALUMINUM ALLOY AND MANUFACTURING METHOD THEREOF

(71) Applicant: UACJ Corporation, Tokyo (JP)

(72) Inventors: Hidenori Hatta, Aichi (JP); Satoshi Udagawa, Aichi (JP); Takero Watanabe, Aichi (JP)

(73) Assignee: UACJ CORPORATION, Tokyo (JP)

( * ) Notice: Subject to any disclaimer, the term of this patent is extended or adjusted under 35 U.S.C. 154(b) by 250 days.

This patent is subject to a terminal disclaimer.

(21) Appl. No.: 15/110,443

(22) PCT Filed: Sep. 26, 2014

(86) PCT No.: PCT/JP2014/075547

§ 371 (c)(1),
(2) Date: Jul. 8, 2016

(87) PCT Pub. No.: WO2015/114880

PCT Pub. Date: Aug. 6, 2015

(65) Prior Publication Data

US 2016/0333453 A1 Nov. 17, 2016

(30) Foreign Application Priority Data

Jan. 29, 2014 (JP) ..... 2014-014288

(51) Int. Cl.
*C22C 21/10* (2006.01)
*C22F 1/053* (2006.01)
*C22C 21/00* (2006.01)

(52) U.S. Cl.
CPC ..... *C22F 1/053* (2013.01); *C22C 21/00* (2013.01); *C22C 21/10* (2013.01)

(58) Field of Classification Search
None
See application file for complete search history.

(56) References Cited

U.S. PATENT DOCUMENTS 5,419,972 A * 5/1995 Kawaguchi ..... G03F 1/64 428/626
6,048,415 A 4/2000 Nakai et al.
(Continued)

FOREIGN PATENT DOCUMENTS

CA 1037296 A * 8/1978
CN 1940106 A 4/2007
(Continued)

OTHER PUBLICATIONS

Gloss Standards and Measurement, White Paper, General Digital Laboratories, Feb. 2007.*
(Continued)

*Primary Examiner* — George Wyszomierski
(74) *Attorney, Agent, or Firm* — J-TEK Law PLLC; Jeffrey D. Tekanic; Scott T. Wakeman

(57) ABSTRACT

An aluminum alloy contains, in mass percent, Zn: 2.5% or more and less than 5.0%, Mg: 2.2% or more and 3.0% or less, and Ti: 0.001% or more and 0.05% or less, Cu: 0.10% or less, Zr: 0.10% or less, Cr: 0.03% or less, Fe: 0.30% or less, Si: 0.30% or less, and Mn: 0.03% or less, the remainder being composed of Al and unavoidable impurities. In addition, the tensile strength is 380 MPa or more; the electrical conductivity is 38.0% IACS or more; and the metallographic structure is composed of a recrystallized structure.

19 Claims, 1 Drawing Sheet

(56) References Cited

U.S. PATENT DOCUMENTS

| | | | | |
|---|---|---|---|---|
| 7,018,489 | B2 | 3/2006 | Bennon et al. | |
| 8,105,449 | B2 | 1/2012 | Yoshida et al. | |
| 2004/0056075 | A1 | 3/2004 | Gheorghe | |
| 2004/0099352 | A1 | 5/2004 | Gheorghe et al. | |
| 2005/0236075 | A1 | 10/2005 | Gheorghe et al. | |
| 2006/0016523 | A1 | 1/2006 | Dif et al. | |
| 2006/0157172 | A1 | 7/2006 | Fischer et al. | |
| 2007/0029016 | A1 | 2/2007 | Gheorghe | |
| 2007/0074791 | A1* | 4/2007 | Yoshida | C22C 21/10 148/439 |
| 2007/0151636 | A1 | 7/2007 | Buerger et al. | |
| 2007/0158198 | A1* | 7/2007 | Huang | B82Y 25/00 205/67 |
| 2007/0187007 | A1 | 8/2007 | Gheorghe et al. | |
| 2008/0299000 | A1 | 12/2008 | Gheorghe et al. | |
| 2009/0223608 | A1 | 9/2009 | Hollrigl et al. | |
| 2012/0055589 | A1 | 3/2012 | Kamat et al. | |
| 2012/0234440 | A1 | 9/2012 | Miyata et al. | |
| 2014/0096878 | A1 | 4/2014 | Hatta et al. | |
| 2014/0124103 | A1 | 5/2014 | Hatta | |
| 2014/0246127 | A1 | 9/2014 | Hatta | |
| 2015/0205195 | A1* | 7/2015 | Yamaguchi | G03F 1/64 428/472.2 |
| 2016/0186302 | A1 | 6/2016 | Hatta et al. | |

FOREIGN PATENT DOCUMENTS

| | | | |
|---|---|---|---|
| CN | 102676962 | A | 9/2012 |
| EP | 0462055 | A1 | 12/1991 |
| GB | 1419491 | A | 12/1975 |
| JP | S62230947 | A | 10/1987 |
| JP | H02170941 | A | 7/1990 |
| JP | H06128678 | A | 5/1994 |
| JP | H06330264 | A | 11/1994 |
| JP | H1161312 | A | 3/1999 |
| JP | 2000119782 | A | 4/2000 |
| JP | 2001355032 | A | 12/2001 |
| JP | 3705320 | B2 | 10/2005 |
| JP | 2010159489 | A | 7/2010 |
| JP | 2010248607 | A | 11/2010 |
| JP | 5023232 | B1 | 9/2012 |
| JP | 2012246555 | A | 12/2012 |
| WO | 2004046402 | A2 | 6/2004 |
| WO | 2007009616 | A1 | 1/2007 |
| WO | 2008003506 | A2 | 1/2008 |
| WO | 2009024601 | A1 | 2/2009 |
| WO | 2012033939 | A2 | 3/2012 |
| WO | 2012176345 | A1 | 12/2012 |
| WO | 2013069603 | A1 | 5/2013 |
| WO | 2015025706 | A1 | 2/2015 |

OTHER PUBLICATIONS

International Standard ISO 7668, Anodized aluminium and aluminium alloys—Measurement of specular reflactance and specular gloss at angles of 20, 45, 60, or 85 deg., First edition, Oct. 15, 1986.*

English translation of International Search Report for parent application No. PCT/JP2014/075547, dated Nov. 25, 2014.

English translation of Written Opinion for parent application No. PCT/JP2014/075547, dated Nov. 25, 2014.

Argument filed by Applicant on Oct. 25, 2017 in related Korean application No. 10-2016-7022946, and machine translation thereof.

Office Action from the Korean Patent Office dated Aug. 25, 2017 in related Korean application No. 10-2016-7022946, and machine translation thereof.

Office Action from the Korean Patent Office dated Oct. 25, 2017 in related Korean application No. 10-2016-7022946, and machine translation thereof.

Office Action from the Chinese Patent Office dated Apr. 1, 2017 in related Chinese application No. 201480074213.7, and machine translation thereof.

Office Action from the Chinese Patent Office dated Oct. 25, 2017 in related Chinese application No. 2014800742131, and machine translation thereof.

Office Action from the Japanese Patent Office dated Oct. 17, 2017 in related Japanese application No. 2014-014288, and machine translation thereof.

Office Action dated Apr. 13, 2018 in counterpart Chinese patent application No. 201480074213.7, and translation of ubstantive portions thereof.

* cited by examiner

HIGH-STRENGTH ALUMINUM ALLOY AND MANUFACTURING METHOD THEREOF

CROSS-REFERENCE

This application is the US national stage of International Patent Application No. PCT/JP2014/075547 filed on Sep. 26, 2014, which claims priority to Japanese Patent Application No. 2014-014288, filed on Jan. 29, 2014.

TECHNICAL FIELD

The present invention relates to a high-strength aluminum alloy that can be used in parts where at least both appearance characteristics and strength properties are considered to be important.

BACKGROUND ART

Aluminum alloys are being increasingly employed as materials for use in sports equipment, transportation equipment, machine parts, and other applications wherein at least strength properties and appearance characteristics are considered to be important. Because durability is required for these applications, it is desirable to use high-strength aluminum alloys having a tensile strength of 380 MPa or more. For example, the aluminum-alloy extruded material described in Patent Document 1 has been proposed as an aluminum alloy for use in applications wherein both strength properties and appearance characteristics are considered to be important.

CITATION LIST

Patent Documents

Patent Document 1
Japanese Laid-open Patent Publication No. 2012-246555

SUMMARY OF THE INVENTION

In a previously existing 7000-series aluminum alloy, the η' phase and the T' phase are precipitated out by the addition of Zn and Mg, and thereby the 7000-series aluminum alloy has excellent strength properties. Nevertheless, in the previously existing 7000-series aluminum alloy, the η' phase and the T' phase exist at crystal-grain boundaries, and therefore ductility is lower than in other aluminum alloys; for example, cracks tend to occur when plastic-worked, which is a problem.

In addition, depending on the application, there are cases in which there is demand for an aluminum alloy wherein the surface has a high luster after a surface treatment, such as an anodization treatment, has been performed. Previously, 5000-series aluminum alloys and the like have often been used in applications wherein high luster is required; however, in recent years, there has been a demand to increase strength further while ensuring high luster. Nevertheless, in the previously existing 7000-series aluminum alloy, there is a problem in that it is difficult to make the surface luster high after anodization treatment, and therefore the alloy is not suited to applications in which high luster is required.

The present invention was conceived against this background, and an object of the present invention is to provide a high-strength aluminum alloy that excels in ductility and post-anodization-treatment appearance characteristics, and a manufacturing method thereof.

One aspect of the present invention is a high-strength aluminum alloy, comprising:

a chemical composition containing, in mass %, Zn: 2.5% or more and less than 5.0%, Mg: 2.2% or more and 3.0% or less, and Ti: 0.001% or more and 0.05% or less, with the restrictions of Cu: 0.10% or less, Zr: 0.10% or less, Cr: 0.03% or less, Fe: 0.30% or less, Si: 0.30% or less, and Mn: 0.03% or less, the remainder being composed of Al and unavoidable impurities;

wherein, the tensile strength is 380 MPa or more;

the electrical conductivity is 38.0% IACS or more; and the metallographic structure is composed of a recrystallized structure.

In addition, another aspect of the present invention is a method of manufacturing the above-mentioned high-strength aluminum alloy, comprising the steps of:

preparing an ingot having a chemical composition containing, in mass %, Zn: 2.5% or more and less than 5.0%, Mg: 2.2% or more and 3.0% or less, and Ti: 0.001% or more and 0.05% or less, with the restrictions of Cu: 0.10% or less, Zr: 0.10% or less, Cr: 0.03% or less, Fe: 0.30% or less, Si: 0.30% or less, and Mn: 0.03% or less, the remainder being composed of Al and unavoidable impurities;

performing a homogenization treatment that heats the ingot at a temperature of 540° C. or higher and 580° C. or lower for 1-24 h;

hot working the ingot, in a state wherein the temperature of the ingot at the start of the working has been set to 440-560° C., thereby making it a wrought material;

performing a quenching treatment that cools by controlling, after cooling has started while the temperature of the wrought material is 400° C. or higher, an average cooling rate, while the temperature of the wrought material is in the range of 400° C. to 150° C., such that it is 1° C./s or more and 300° C./s or less;

cooling the temperature of the wrought material to room temperature by the quenching treatment or by cooling thereafter; and subsequently performing an artificial-aging treatment on the wrought material.

The above-mentioned high-strength aluminum alloy has the above-mentioned specific chemical composition, the tensile strength being 380 MPa or more and the metallographic structure being composed of a recrystallized structure. Thereby, the above-mentioned high-strength aluminum alloy is high strength, excels in ductility, and excels in appearance characteristics after the anodization treatment, and can be suitably used in applications in which these properties and characteristics are considered to be important.

That is, the above-mentioned high-strength aluminum alloy has strength properties equal to or better than those of the above-mentioned previously existing 7000-series aluminum alloy, that is, a tensile strength of 380 MPa or more. Consequently, it is possible to relatively easily meet the requirements for strength, such as ensuring strength properties that can support, for example, a reduction in wall thickness in order to reduce weight.

In addition, the above-mentioned high-strength aluminum alloy has the above-mentioned specific chemical composition, and thereby has excellent ductility while ensuring superior strength properties. Consequently, in the above-mentioned high-strength aluminum alloy, workability, such as, for example, when working, is satisfactory.

In addition, the above-mentioned high-strength aluminum alloy has the above-mentioned specific chemical composition and a metallographic structure composed of a recrystallized structure. Consequently, in the above-mentioned high-strength aluminum alloy, the formation of streak patterns, caused by fibrous structures after the anodization treatment, and the like can be inhibited and a surface having high luster can be achieved, and thereby the alloy has excellent appearance characteristics.

Next, in the above-mentioned high-strength aluminum alloy manufacturing method, the above-mentioned high-strength aluminum alloy is manufactured based on the above-mentioned specific treatment temperatures, treatment times, and treatment procedures. Consequently, the above-mentioned excellent high-strength aluminum alloy can be easily obtained.

DETAILED DESCRIPTION

Figure 1:
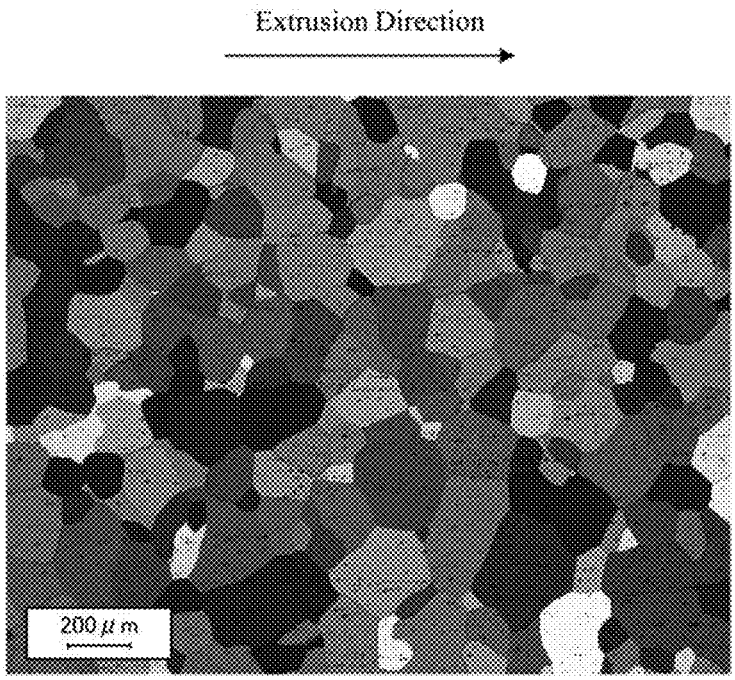
FIG. 1 is a photograph that shows the metallographic structure of a sample 2 according to Working Example 1.

The reasons for the range limits of the content of each element in the above-mentioned high-strength aluminum alloy will be explained. The above-mentioned high-strength aluminum alloy contains Zn, Mg, and Ti as essential components.

Zn: 2.5% or More and Less than 5.0%

Zn is an element that coexists with Mg in the aluminum alloy and thereby precipitates the η' and/or T' phase. By containing Zn together with Mg, it is possible to obtain a strength-increasing effect due to enhanced precipitation. If the Zn content is less than 2.5%, then the η' phase and T' phase precipitated amount becomes small, and consequently the strength-increasing effect is lowered. Consequently, the Zn content is set to 2.5% or more. On the other hand, if the Zn content is 5.0% or more, then there is a risk that ductility will decrease and that the luster after anodization treatment will decrease, and thereby the appearance characteristics will become insufficient. Consequently, the Zn content is set to less than 5.0%. From the same viewpoint, the Zn content is preferably set to 4.8% or less.

Mg: 2.2% or More and 3.0% or Less

Mg is an element that coexists with Zn in the aluminum alloy and thereby precipitates the η' and/or T' phase. By containing Mg together with Zn, it is possible to obtain a strength-increasing effect due to the enhancement of precipitation. If the Mg content is less than 2.2%, then the η' phase and/or T' phase precipitated amount becomes small, and consequently the strength-increasing effect is lowered. On the other hand, if the Mg content exceeds 3.0%, then there is a risk that hot workability will decrease, productivity will decrease, and ductility will decrease. In addition, if the Mg content exceeds 3.0%, then there is a risk that the luster after anodization treatment will decrease and thereby the appearance characteristics will become insufficient.

Ti: 0.001% or More and 0.05% or Less

By being added to the aluminum alloy, Ti has the effect of making the ingot structure fine. The finer the ingot structure becomes, the easier it is to achieve a high luster surface without spots; consequently, it is possible to improve the appearance characteristics of the above-mentioned high-strength aluminum alloy by the addition of Ti. If the Ti content is less than 0.001%, then the ingot structure is not made sufficiently fine, and consequently there is a risk that spots and streak patterns will arise on the surface of the above-mentioned high-strength aluminum alloy and thereby the appearance characteristics will become insufficient. In addition, if the Ti content is greater than 0.05%, then an AlTi-based intermetallic compound or the like will be formed with the Al, and dot-like or streak patterns will tend to be generated, and consequently there is a risk that the appearance characteristics will become insufficient.

In addition, the above-mentioned high-strength aluminum alloy may contain Cu, Zr, Cr, Fe, Si, and Mn as optional components.

Cu: 0.10% or Less

If a recycled material is used as the raw material of the above-mentioned high-strength aluminum alloy, then Cu might be intermixed therein. If the Cu content exceeds 0.10%, then there is a risk that surface luster after anodization treatment has been performed will decrease, thereby causing, for example, the color tone of the surface to change to yellow and thereby the appearance characteristics to become insufficient. To avoid such a problem, the Cu content is restricted to 0.10% or less.

Zr: 0.10% or Less

If the Zr content exceeds 0.10%, then the formation of a recrystallized structure is inhibited and, instead, fibrous structures tend to be formed. If the above-mentioned fibrous structures are present, then after the anodization treatment is performed, streak patterns caused by the fibrous structures tend to appear on the surface, and consequently there is a risk that the appearance characteristics will become insufficient. To avoid such problems, the Zr content is restricted to 0.10% or less.

Cr: 0.03% or Less

If the Cr content exceeds 0.03%, then the formation of a recrystallized structure is inhibited and, instead, fibrous structures tend to be formed. Consequently, after the anodization treatment has been performed, streak patterns tend to appear on the surface due to the above-mentioned fibrous structures, and therefore there is a risk that the appearance characteristics will become insufficient. To avoid such problems, the Cr content is restricted to 0.03% or less.

Fe: 0.30% or Less, Si: 0.30% or Less, Mn: 0.03% or Less

Fe and Si are components that might be mixed into the aluminum ore as impurities, and Mn is a component that might be mixed in if a recycled material is used. Fe, Si, and Mn have the effect of inhibiting recrystallization by forming AlMn-based, AlMnFe-based, or AlMnFeSi-based intermetallic compounds with Al. Consequently, if the above-mentioned three components are excessively mixed into the above-mentioned high-strength aluminum alloy, then the formation of the recrystallized structure is inhibited and, instead, fibrous structures tend to be formed. Consequently, after the anodization treatment has been performed, streak patterns tend to appear on the surface due to the fibrous structures, and therefore there is a risk that the appearance characteristics will become insufficient. To avoid such problems, Fe is restricted to 0.30% or less, Si is restricted to 0.30% or less, and Mn is restricted to 0.03% or less.

As described above, the above-mentioned high-strength aluminum alloy can also have a composition that contains the above-mentioned optional components; however, if too much of the above-mentioned optional components are included, then there is a risk that the appearance characteristics will be lost. Consequently, from the viewpoint of ensuring the appearance characteristics, the content of the above-mentioned optional components is restricted to the above-mentioned specific ranges. From the same viewpoint, it is particularly preferable to make the composition such that it does not contain the above-mentioned optional components.

Next, as described above, the metallographic structure of the above-mentioned high-strength aluminum alloy comprises a granular recrystallized structure. Because an aluminum alloy prepared by performing hot working normally has a metallographic structure composed of fibrous structures, streak patterns tend to arise on the surface and, as a result, there is a risk that the appearance characteristics will become insufficient. On the other hand, in the above-mentioned high-strength aluminum alloy, the metallographic structure comprises a recrystallized structure; consequently, streak patterns are not formed on the surface and therefore the alloy has excellent appearance characteristics.

In addition, in the above-mentioned high-strength aluminum alloy, the electrical conductivity at 25° C. is 38.0% IACS or more. The larger the value of the electrical conductivity, the smaller the amount of solute atoms that are dissolved in the aluminum matrix; consequently, the amount of solute atoms can be controlled using the electrical conductivity as an indicator. In the above-mentioned high-strength aluminum alloy having electrical conductivity in the above-mentioned specific range, the amount of solute atoms dissolved is controlled such that it is in a suitable range; as a result, the aluminum matrix tends to deform. That is why the above-mentioned high-strength aluminum alloy has excellent ductility.

In addition, in the above-mentioned high-strength aluminum alloy, an anodization treatment was performed wherein a sulfuric-acid bath was used on a surface that had been mirror-polished, and the gloss value, obtained when the angle of incidence of a light beam was set to 60° C., of the surface, whereon an anodic oxide film having a film thickness of 8 μm had been formed, was 600 or more. By having at least the above-mentioned specific chemical composition, a surface with a gloss value of 600 or more can be achieved with the above-mentioned high-strength aluminum alloy. The aluminum alloy having a gloss value in the above-mentioned specific range has adequately high luster while high strength properties are ensured, and consequently the aluminum alloy is suited to applications wherein both strength properties and luster are required.

In the above-mentioned recrystallized structure, the average grain diameter of the crystal grains is preferably 500 μm or less, and the crystal-grain length in the direction parallel to the hot-working direction is preferably 0.5-4 times that of the crystal-grain length in the direction perpendicular to the hot-working direction.

If the above-mentioned average grain diameter of the crystal grains exceeds 500 μm, then the crystal grains become excessively coarse, and consequently spots tend to form on the surface after a surface treatment, such as the anodization treatment, is performed, and therefore there is a risk that the appearance characteristics will become insufficient. Consequently, the smaller the average grain diameter of the crystal grains, the better.

In addition, if the aspect ratio of the above-mentioned crystal grains, that is, the ratio of the crystal-grain length in the direction parallel to the hot-working direction with respect to the crystal-grain length in the direction perpendicular to the hot-working direction, exceeds 4, then there is a risk that streak patterns will appear on the surface after the anodization treatment has been performed and that the appearance characteristics will become insufficient. On the other hand, crystal grains having an aspect ratio of less than 0.5 are difficult to obtain with generally used manufacturing equipment.

Furthermore, it is possible to confirm whether the above-mentioned metallographic structure is a recrystallized structure by, for example, subjecting the surface of the aluminum alloy to an etching treatment and then observing the resulting surface using a polarizing microscope. That is, if the above-mentioned metallographic structure is composed of a recrystallized structure, then a uniform metallographic structure composed of granular crystals will be observed, and a solidified structure, which could be formed during casting, as represented by coarse intermetallic compounds, floating crystals, and the like, will not be seen. Similarly, a stripe-shaped structure (a so-called worked structure) formed by plastic working, such as extrusion or rolling, will not be seen in a metallographic structure composed of a recrystallized structure.

In addition, the average grain diameter of the crystal grains in the above-mentioned recrystallized structure can be calculated, in accordance with the sectioning method stipulated in JIS G 0551 (ASTM E 112-96, ASTM E 1382-97), based on the metallographic image obtained by observation using the polarizing microscope described above. That is, the average grain diameter can be calculated by drawing, at an arbitrary position in the above-mentioned metallographic image, one sectioning-plane line in each of the longitudinal, transverse, and diagonal directions, and then dividing the length of each sectioning-plane line by the number of crystal-grain boundaries that intersect the sectioning-plane line.

In addition, the above-mentioned aspect ratio, that is, the ratio of the crystal-grain length in the direction parallel to the hot-working direction with respect to the crystal-grain length in the direction perpendicular to the hot-working direction, can be calculated in accordance with the method described above. That is, as in the method described above, sectioning-plane lines are drawn at an arbitrary position in the above-mentioned metallographic image in the direction parallel to and the direction perpendicular to the hot-working direction, and the average grain diameter is calculated in the direction parallel to and the direction perpendicular to the hot-working direction from each of the sectioning-plane lines. Furthermore, the above-mentioned aspect ratio can be calculated by dividing the average grain diameter in the direction parallel to the hot-working direction by the average grain diameter in the direction perpendicular to the hot-working direction.

The above-mentioned recrystallized structure is preferably one that is formed during hot working. The recrystallized structure can be classified, depending on the manufacturing process, into a dynamic recrystallized structure and a static recrystallized structure; a recrystallized structure that is formed through the performance of repetitive recrystallization simultaneous with deformation during the hot working is called a dynamic recrystallized structure. On the other hand, a static recrystallized structure means one formed by first performing hot working or cold working, and then adding a heat-treatment process, such as a solution heat treatment or an annealing treatment. The problem to be solved by the present invention described above can be solved for either recrystallized structure; however, in the case of the dynamic recrystallized structure, the production process is simple, and consequently the above-mentioned high-strength aluminum alloy can be manufactured more easily.

Next, a method of manufacturing the above-mentioned high-strength aluminum alloy will be explained. In the above-mentioned high-strength aluminum alloy manufacturing method, a homogenization treatment is performed wherein an ingot having the above-mentioned chemical composition is heated at a temperature of 540° C. or higher and 580° C. or lower for 1 h or more and 24 h or less. If the heating temperature in the above-mentioned homogenization treatment is lower than 540° C., then the homogenization of the ingot segregation layer will become insufficient. As a result, the crystal grains will become coarse, a non-uniform crystalline structure will be formed, and the like; consequently, there is a risk that the appearance characteristics of the alloy material ultimately obtained will become insufficient. On the other hand, if the heating temperature is higher than 580° C., then there is a risk that the ingot will melt locally, consequently making manufacture difficult. Accordingly, the temperature of the above-mentioned homogenization treatment is preferably 540° C. or higher and 580° C. or lower.

In addition, if the heating time for the above-mentioned homogenization treatment is less than 1 h, then the homogenization of the ingot segregation layer will become insufficient, and consequently there is a risk that the ultimate appearance characteristics will become insufficient in the same manner as described above. On the other hand, if the heating time exceeds 24 h, then a state will result wherein the ingot segregation layer has been sufficiently homogenized, and consequently no further effect can be expected. Accordingly, the time for the above-mentioned homogenization treatment is preferably 1 h or more and within 24 h.

After being subjected to the above-mentioned homogenization treatment, the ingot undergoes hot working and thereby is made into a wrought material. The temperature of the ingot at the start of hot working is set to 440° C. or higher and 560° C. or lower. If the heating temperature of the ingot before hot working is lower than 440° C., then the deformation resistance will become high, making it difficult to work using generally used manufacturing equipment. On the other hand, if hot working is performed after the ingot has been heated to a temperature that exceeds 560° C., then the ingot locally melts owing to the inclusion of the heat generated during the working; as a result, there is a risk that hot cracking will occur. Accordingly, the temperature of the ingot before hot working is preferably 440° C. or higher and 560° C. or lower. Furthermore, extruding, rolling, and the like can be employed as the above-mentioned hot working.

After the above-mentioned hot working has been performed, a quenching treatment is performed wherein cooling is started while the temperature of the wrought material is 400° C. or higher, and the temperature of the wrought material is then cooled until it becomes 150° C. or lower. If the temperature of the wrought material before the above-mentioned quenching treatment is below 400° C., then the quench-hardening effect will become insufficient; as a result, there is a risk that the tensile strength of the resulting aluminum alloy will be less than 380 MPa. In addition, in the case wherein the temperature of the wrought material after the quenching treatment exceeds 150° C., too, the quench-hardening effect will become insufficient; as a result, there is a risk that the tensile strength of the resulting aluminum alloy will be less than 380 MPa.

Furthermore, the above-mentioned quenching treatment means a treatment that cools the wrought material by a forcible means. For example, cooling methods such as forcible quenching using a fan, shower cooling, water cooling, and the like can be employed as the above-mentioned quenching treatment.

In addition, in the above-mentioned quenching treatment, while the temperature of the wrought material is in the range of from 400° C. to 150° C., the average cooling rate is controlled such that it is 1° C./s or more and 300° C./s or less. If the average cooling rate exceeds 300° C./s, then excessively robust equipment will be needed and, moreover, a commensurate effect cannot be obtained. On the other hand, if the average cooling rate is less than 1° C./s, then the quench-hardening effect will be insufficient, and consequently there is a risk that the tensile strength of the resulting aluminum alloy will be less than 380 MPa. Accordingly, a faster average cooling rate is better, preferably 1° C./s or more and 300° C./s or less, and more preferably 3° C./s or more and 300° C./s or less.

In addition, after the above-mentioned quenching treatment has been performed, the temperature of the wrought material is brought to room temperature. The temperature may be brought to room temperature by the above-mentioned quenching treatment or by performing an additional cooling treatment after the quenching treatment. Because the effect of room-temperature aging arises by virtue of bringing the temperature of the wrought material to room temperature, the strength of the above-mentioned high-strength aluminum alloy increases. Furthermore, for example, cooling methods such as fan air cooling, mist cooling, shower cooling, water cooling, and the like can be employed as the above-mentioned additional cooling treatment.

Here, if the above-mentioned wrought material is stored in the state wherein it is maintained at room temperature, then the strength of the above-mentioned high-strength aluminum alloy will further increase owing to the effect of the room-temperature aging. In the initial stage, the longer the room-temperature aging time, the greater the increase in strength; however, when the room-temperature aging time becomes 24 h or more, the effect of room-temperature aging reaches its maximum.

Next, an artificial-aging treatment is performed wherein the above-mentioned wrought material, which has been cooled to room temperature as described above, is heated. The performance of the artificial-aging treatment finely and uniformly precipitates $MgZn_2$ in the above-mentioned wrought material, and consequently the tensile strength of the above-mentioned high-strength aluminum alloy can easily be set to 380 MPa or more. Any of the aspects below can be applied as specific conditions of the above-mentioned artificial-aging treatment.

First, a first artificial-aging treatment, wherein the above-mentioned wrought material is heated at a temperature of 80-120° C. for 1-5 h, and thereafter a second artificial-aging treatment, which is performed following the first artificial-aging treatment and wherein the wrought material is heated at a temperature of 145-200° C. for 2-15 h, can be performed as the above-mentioned artificial-aging treatment.

Here, successively performing the first artificial-aging treatment and the second artificial-aging treatment means completing the first artificial-aging treatment and thereafter performing the second artificial-aging treatment while maintaining the temperature of the wrought material. That is, the wrought material should not be cooled between the first artificial-aging treatment and the second artificial-aging treatment; as a specific method, there is a method wherein, after the first artificial-aging treatment, the second artificial-aging treatment is performed without removing the wrought material from the heat-treatment furnace.

Thus, by successively performing the above-mentioned first artificial-aging treatment and the above-mentioned second artificial-aging treatment, the artificial-aging treatment time can be shortened. In addition, the treatment temperature in the second artificial-aging treatment should be 145-200° C. If the heating in the second artificial-aging treatment is performed in the range of 170-200° C., then the ductility of the above-mentioned high-strength aluminum alloy will become high, which makes it possible to further improve workability when performing plastic working, etc. Furthermore, if the conditions in the second artificial-aging treatment deviate from the above-mentioned temperature range or time range, then there are risks that the ductility and the tensile strength of the resulting aluminum alloy will be insufficient.

In addition, a treatment wherein the wrought material is heated at a temperature of 145-180° C. for 1-24 h can also be performed as the above-mentioned artificial-aging treatment. In this case, because the manufacturing process is simple, the above-mentioned high-strength aluminum alloy can be manufactured more easily. If the above-mentioned artificial-aging treatment deviates from the above-mentioned temperature range or time range, there is a risk that the ductility and the tensile strength of the resulting aluminum alloy will be insufficient.

WORKING EXAMPLES

Working Example 1

Working examples according to the above-mentioned high-strength aluminum alloy will now be explained, making use of Table 1 to Table 3. In the present example, as shown in Table 1 and Table 2, samples (sample 1 to sample 24) having varying chemical compositions of the aluminum alloy were prepared under the same manufacturing conditions, each sample was subjected to a tensile test, and the metallographic structure of each sample was observed. Furthermore, after each sample was subjected to a surface treatment, an appearance-characteristics evaluation was performed.

Below, the manufacturing conditions, the strength-measuring method, the metallographic-structure observing method, as well as the surface-treating method and the appearance-characteristics evaluating method of the samples will be explained.

TABLE 1

| | Chemical Composition (mass %) | | | | | | | | | |
|---|---|---|---|---|---|---|---|---|---|---|
| | Zn | Mg | Cu | Fe | Si | Mn | Cr | Ti | Zr | Al |
| Sample 1 | 2.6 | 2.4 | 0.06 | 0.13 | 0.07 | 0.00 | 0.00 | 0.010 | 0.00 | bal. |
| Sample 2 | 4.8 | 2.4 | 0.06 | 0.13 | 0.08 | 0.00 | 0.00 | 0.010 | 0.00 | bal. |
| Sample 3 | 4.5 | 2.3 | 0.06 | 0.12 | 0.08 | 0.00 | 0.00 | 0.010 | 0.00 | bal. |
| Sample 4 | 4.5 | 2.9 | 0.05 | 0.12 | 0.08 | 0.00 | 0.00 | 0.010 | 0.00 | bal. |
| Sample 5 | 4.5 | 2.4 | 0.09 | 0.12 | 0.08 | 0.00 | 0.00 | 0.010 | 0.00 | bal. |
| Sample 6 | 4.4 | 2.5 | 0.00 | 0.23 | 0.08 | 0.00 | 0.00 | 0.010 | 0.00 | bal. |
| Sample 7 | 4.4 | 2.5 | 0.05 | 0.13 | 0.20 | 0.00 | 0.00 | 0.010 | 0.00 | bal. |
| Sample 8 | 4.4 | 2.5 | 0.05 | 0.13 | 0.08 | 0.02 | 0.00 | 0.010 | 0.00 | bal. |
| Sample 9 | 4.5 | 2.4 | 0.05 | 0.05 | 0.02 | 0.00 | 0.02 | 0.010 | 0.00 | bal. |
| Sample 10 | 4.4 | 2.5 | 0.05 | 0.05 | 0.02 | 0.00 | 0.00 | 0.005 | 0.00 | bal. |
| Sample 11 | 4.4 | 2.4 | 0.05 | 0.13 | 0.08 | 0.00 | 0.00 | 0.040 | 0.00 | bal. |
| Sample 12 | 4.4 | 2.4 | 0.05 | 0.12 | 0.07 | 0.00 | 0.00 | 0.020 | 0.07 | bal. |

TABLE 2

| | Chemical Composition (mass %) | | | | | | | | | |
|---|---|---|---|---|---|---|---|---|---|---|
| | Zn | Mg | Cu | Fe | Si | Mn | Cr | Ti | Zr | Al |
| Sample 13 | 2.3 | 2.4 | 0.06 | 0.13 | 0.07 | 0.00 | 0.00 | 0.010 | 0.00 | bal. |
| Sample 14 | 5.1 | 2.4 | 0.06 | 0.13 | 0.08 | 0.00 | 0.00 | 0.010 | 0.00 | bal. |
| Sample 15 | 4.5 | 2.1 | 0.06 | 0.12 | 0.08 | 0.00 | 0.00 | 0.010 | 0.00 | bal. |
| Sample 16 | 4.5 | 3.1 | 0.05 | 0.12 | 0.08 | 0.00 | 0.00 | 0.010 | 0.00 | bal. |
| Sample 17 | 4.5 | 2.4 | 0.12 | 0.12 | 0.08 | 0.00 | 0.00 | 0.010 | 0.00 | bal. |
| Sample 18 | 4.4 | 2.5 | 0.00 | 0.31 | 0.08 | 0.00 | 0.00 | 0.010 | 0.00 | bal. |
| Sample 19 | 4.4 | 2.5 | 0.05 | 0.13 | 0.32 | 0.00 | 0.00 | 0.010 | 0.00 | bal. |
| Sample 20 | 4.4 | 2.5 | 0.05 | 0.13 | 0.08 | 0.04 | 0.00 | 0.010 | 0.00 | bal. |
| Sample 21 | 4.5 | 2.4 | 0.05 | 0.05 | 0.02 | 0.00 | 0.04 | 0.010 | 0.00 | bal. |
| Sample 22 | 4.4 | 2.5 | 0.05 | 0.05 | 0.02 | 0.00 | 0.00 | 0.000 | 0.00 | bal. |
| Sample 23 | 4.4 | 2.4 | 0.05 | 0.13 | 0.08 | 0.00 | 0.00 | 0.070 | 0.00 | bal. |
| Sample 24 | 4.4 | 2.4 | 0.05 | 0.12 | 0.07 | 0.00 | 0.00 | 0.020 | 0.12 | bal. |

<Preparation Method of Samples>

Ingots having a diameter of 90 mm and the chemical compositions listed in Table 1 and Table 2 were cast by semi-continuous casting. Subsequently, a homogenization treatment was performed wherein the ingots were heated at a temperature of 555° C. for 5 h. Subsequently, hot extrusion was started in a state wherein the temperature of the ingots was 520° C., and the hot extrusion was performed on the ingots; thereby, wrought materials having a width of 35 mm and a thickness of 7 mm were prepared. Subsequently, a quenching treatment was started in a state wherein the temperature of the wrought materials was 510° C. or higher. The average cooling rate in the quenching treatment was set to 60° C./s, and the temperature at the end of treatment was set to 100° C. Furthermore, the wrought materials subjected to the quenching treatment were cooled to room temperature and then subjected to room-temperature aging for 48 h at room temperature. Subsequently, the first artificial-aging treatment was performed wherein the wrought materials were heated using a heat-treatment furnace at a temperature of 100° C. for 3 h. Thereafter, the second artificial-aging treatment was performed wherein the furnace temperature was raised to 150° C. without removing the wrought materials from the heat-treatment furnace, and the wrought materials were heated at 150° C. for 8 h. Based on the above, the samples were obtained.

<Tensile-Testing Method>

No. 5 test pieces were collected from the samples using the method in accordance with JIS Z 2241 (ISO 6892-1), and tensile strength, proof stress, and elongation were measured. As a result, if the tensile strength was 380 MPa or more and the elongation was 18% or more, then it was judged to be acceptable. Furthermore, the No. 5 test pieces were collected such that the longitudinal direction was parallel to the hot-working direction.

<Metallographic Structure Observing Method>

After the samples were subjected to electrolytic polishing and electrolytic etching, micrographs of the sample surfaces were acquired using a polarizing microscope having a magnification of 50-100 times. Image analysis was performed on the micrographs and, as described above, the average grain diameter of the crystal grains constituting the metallographic structure of each of the samples was derived in accordance with the sectioning method stipulated in JIS G 0551. In addition, as described above, each of the aspect ratios (indicating the ratio of the crystal-grain length in the direction parallel to the hot-working direction with respect to the crystal-grain length in the direction perpendicular to the hot-working direction) was calculated by dividing the average grain diameter in the direction parallel to the hot-working direction by the average grain diameter in the direction perpendicular to the hot-working direction. As a result, those having an average grain diameter of 500 μm or less and those having an aspect ratio within a range of 0.5-4.0 were judged to be preferable results.

<Surface Treating Method>

The surfaces of the samples that were subjected to the artificial-aging treatment were subjected to paper polishing up to #2400, then buffed and mirror finished. Subsequently, the sample surfaces were subjected to an anodization treatment in a 15% sulfuric-acid bath at an electric current density of 150 A/m2, thereby forming an anodic oxide film having a film thickness of 8 μm. Lastly, the anodic oxide films were subjected to a sealing treatment by immersing the samples, after they were subjected to the anodization treatment, in boiling water. The appearance-characteristics evaluation described below was carried out using samples that had undergone the above treatments.

<Appearance-Characteristics Evaluating Method>

Visual Observation

The surfaces of the samples were visually observed. As a result, if a streak pattern, a spotting pattern, a dot-like defect, or the like did not appear on the surface, then the surface was judged to be acceptable in the visual observation.

Degree of Luster

The gloss value of the sample surfaces was measured using a variable-angle gloss meter (GM-3D made by Murakami Color Research Laboratory Co., Ltd.). As a result, if the gloss value was 600 or more, then the luster property was judged to be acceptable. Furthermore, the angle of incidence of the light beam was set to 60° in the measurement of the gloss value.

<Electrical-Conductivity Measuring Method>

The electrical conductivity of each sample when the temperature was 25° C. was measured using an electrical-conductivity meter (SIGMATEST® 2.069 made by Foerster Co.). As a result, if the electrical conductivity was 38.0% IACS or more, it was judged to be a preferable result.

The evaluation results of the samples in Table 1 and Table 2 are shown in Table 3. Furthermore, those evaluation results in Table 3 not judged to be acceptable or not judged to be a preferable result are shown underlined.

TABLE 3

| | Tension Test | | | Metallographic Structure Observation | | Appearance-Characteristics Evaluation | | |
|---|---|---|---|---|---|---|---|---|
| | Tensile Strength (MPa) | Proof Stress (Mpa) | Elongation (%) | Average Crystal Grain Diameter (μm) | Aspect Ratio | Visual Observation | Gloss Value | Conductivity (% IACS) |
| Sample 1 | 394 | 350 | 22 | 100 | 1.2 | Acceptable | 642 | 39.0 |
| Sample 2 | 436 | 406 | 18 | 110 | 1.2 | Acceptable | 612 | 38.3 |
| Sample 3 | 395 | 351 | 23 | 100 | 1.3 | Acceptable | 641 | 39.4 |
| Sample 4 | 437 | 408 | 19 | 110 | 1.2 | Acceptable | 613 | 38.1 |
| Sample 5 | 425 | 406 | 22 | 105 | 1.2 | Acceptable | 615 | 38.6 |
| Sample 6 | 428 | 401 | 19 | 120 | 1.2 | Acceptable | 603 | 38.3 |
| Sample 7 | 423 | 404 | 18 | 105 | 1.3 | Acceptable | 604 | 38.9 |
| Sample 8 | 425 | 408 | 20 | 115 | 1.2 | Acceptable | 623 | 38.7 |

TABLE 3-continued

| | Tension Test | | | Metallographic Structure Observation | | Appearance-Characteristics Evaluation | | |
|---|---|---|---|---|---|---|---|---|
| | Tensile Strength (MPa) | Proof Stress (Mpa) | Elongation (%) | Average Crystal Grain Diameter (μm) | Aspect Ratio | Visual Observation | Gloss Value | Conductivity (% IACS) |
| Sample 9 | 426 | 409 | 19 | 110 | 1.3 | Acceptable | 620 | 38.8 |
| Sample 10 | 422 | 404 | 20 | 100 | 1.1 | Acceptable | 611 | 38.8 |
| Sample 11 | 426 | 405 | 20 | 115 | 1.2 | Acceptable | 630 | 38.5 |
| Sample 12 | 431 | 410 | 18 | 120 | 1.5 | Acceptable | 611 | 38.3 |
| Sample 13 | 373 | 331 | 23 | 105 | 1.3 | Acceptable | 653 | 39.8 |
| Sample 14 | 452 | 423 | 14 | 105 | 1.2 | Acceptable | 582 | 37.8 |
| Sample 15 | 375 | 339 | 25 | 100 | 1.2 | Acceptable | 657 | 39.7 |
| Sample 16 | 447 | 419 | 17 | 120 | 1.1 | Acceptable | 581 | 37.4 |
| Sample 17 | 423 | 403 | 23 | 100 | 1.2 | Acceptable | 597 | 38.5 |
| Sample 18 | 425 | 400 | 18 | — | >4 | Unacceptable | 576 | 38.0 |
| Sample 19 | 421 | 401 | 18 | — | >4 | Unacceptable | 581 | 38.9 |
| Sample 20 | 428 | 411 | 21 | — | >4 | Unacceptable | 594 | 38.4 |
| Sample 21 | 422 | 405 | 18 | — | >4 | Unacceptable | 596 | 38.6 |
| Sample 22 | 420 | 401 | 21 | 140 | 1.2 | Unacceptable | 580 | 38.7 |
| Sample 23 | 427 | 409 | 17 | 130 | 1.5 | Unacceptable | 630 | 38.4 |
| Sample 24 | 445 | 426 | 16 | — | >4 | Unacceptable | 597 | 38.1 |

As can be understood from Table 3, sample 1 to sample 12 were acceptable for all evaluation items and exhibited excellent strength properties, ductility, and appearance characteristics.

As a representative example of a sample having excellent appearance characteristics, FIG. 1 shows the metallographic structure observation result of sample 2. As can be understood from the same figure, samples having excellent appearance characteristics have a metallographic structure composed of a granular recrystallized structure and, simultaneously, no streak pattern is observed even by visual confirmation and the samples have a high luster without any spots.

Figure 2:
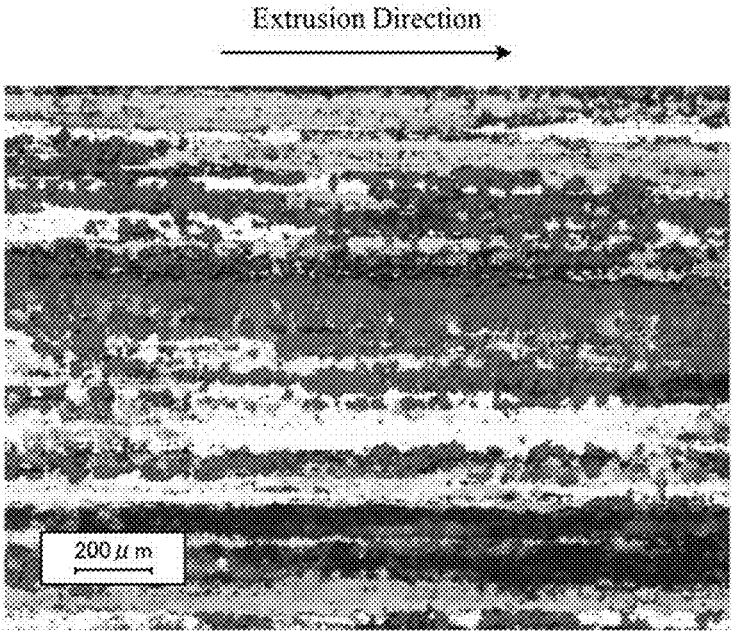
FIG. 2 is a photograph that shows an example of the metallographic structure of fibrous structures.

On the other hand, as an example of a metallographic structure of fibrous structures, FIG. 2 shows a metallographic photograph of a previously existing aluminum-alloy extruded material. When fibrous structures are formed as shown in the same drawing, streak patterns tend to form on the surface after the anodization treatment has been performed, and therefore the appearance characteristics become insufficient.

In sample 13, the Zn content was too low, and consequently the tensile strength was insufficient and was judged to be unacceptable.

In sample 14, the Zn content was too high, and consequently the elongation and the gloss value were insufficient and were judged to be unacceptable.

In sample 15, the Mg content was too low, and consequently the tensile strength was insufficient and was judged to be unacceptable.

In sample 16, the Mg content was too high, and consequently cracks occurred in parts of the wrought material when subjected to hot extrusion. After collecting and evaluating samples from portions where cracks did not occur, it was found that the elongation and the gloss values were insufficient and were judged to be unacceptable.

In sample 17, the Cu content was too high, and consequently the gloss value was insufficient and was judged to be unacceptable.

In sample 18, the Fe content was too high, and consequently fibrous structures formed; as a result, streak patterns were visually confirmed on the surface. In addition, in sample 18, the gloss value was insufficient. As a result, in sample 18, the appearance characteristics were insufficient and were judged to be unacceptable.

In sample 19, the Si content was too high, and consequently fibrous structures formed; as a result, streak patterns were visually confirmed on the surface. In addition, in sample 19, the gloss value was insufficient. As a result, in sample 19, the appearance characteristics were insufficient and were judged to be unacceptable.

In sample 20, the Mn content was too high, and consequently fibrous structures formed; as a result, streak patterns were visually confirmed on the surface. In addition, in sample 20, the gloss value was insufficient. As a result, in sample 20, the appearance characteristics were insufficient and were judged to be unacceptable.

In sample 21, the Cr content was too high, and consequently fibrous structures formed; as a result, streak patterns were visually confirmed on the surface. In addition, in sample 21, the gloss value was insufficient. As a result, in sample 21, the appearance characteristics were insufficient and were judged to be unacceptable.

In sample 22, the Ti content was too low, and consequently streak patterns caused by the coarse ingot structure were visually confirmed. In addition, in sample 22, the gloss value was insufficient. As a result, in sample 22, the appearance characteristics were insufficient and were judged to be unacceptable.

In sample 23, the Ti content was too high, and consequently the Ti formed an intermetallic compound with the Al; as a result, stripe-shaped and dot-like defects were visually confirmed on the surface. In addition, in sample 23, the elongation was insufficient. As a result, in sample 23, the elongation and the appearance characteristics were insufficient and were judged to be unacceptable.

In sample 24, the Zr content was too high, and consequently fibrous structures formed; as a result, streak patterns were visually confirmed on the surface. In addition, in sample 24, the elongation and the gloss value were insufficient. As a result, in sample 24, the elongation and the appearance characteristics were insufficient and were judged to be unacceptable.

Working Example 2

Next, a working example according to the above-mentioned high-strength aluminum alloy manufacturing method will be explained, making use of Table 4 to Table 7.

In the present example, samples (sample A1 to sample A29) were prepared, using an aluminum alloy (alloy A) containing the chemical composition listed in Table 4, by modifying the manufacturing conditions as listed in Table 5 and Table 6, after which the strength of each sample was measured and the metallographic structure of each sample was observed. Furthermore, after each sample was subjected to a surface treatment, an appearance-characteristics evaluation was performed.

Below, the manufacturing conditions of each sample will be explained. Furthermore, the strength measuring method, the metallographic structure observing method, the surface treating method, and the appearance-characteristics evaluating method for each sample were performed using the same methods as those in Working Example 1.

<Manufacturing Conditions of Samples>

An ingot having a diameter of 90 mm and the chemical composition listed in Table 4 was cast by semi-continuous casting. Subsequently, using combinations of the temperatures, times, and average cooling rates listed in Table 5 and Table 6, the ingot was subjected to, in order, a homogenization treatment, hot extrusion, a quenching treatment, a first artificial-aging treatment, and a second artificial-aging treatment, and thereby the samples were obtained. Furthermore, "room-temperature aging time" in Table 5 and Table 6 means the time from when the wrought material reaches room temperature after the performance of the quenching treatment until the performance of the first artificial-aging treatment.

TABLE 4

| | Chemical Composition (mass %) | | | | | | | | | |
|---|---|---|---|---|---|---|---|---|---|---|
| | Zn | Mg | Cu | Fe | Si | Mn | Cr | Ti | Zr | Al |
| Alloy A | 4.4 | 2.3 | 0.06 | 0.13 | 0.08 | 0.00 | 0.00 | 0.010 | 0.00 | bal. |

TABLE 5

| | Homogenization Treatment | | Hot Working Extruding | Quenching Treatment | | Room-Temp. Aging | First Artificial Aging | | Second Artificial Aging | |
|---|---|---|---|---|---|---|---|---|---|---|
| | Temp. (° C.) | Time (h) | Temp. (° C.) | Cooling Rate (° C./s) | Temp. When Completed (° C.) | Time (h) | Temp. (° C.) | Time (h) | Temp. (° C.) | Time (h) |
| Sample A1 | 540 | 6 | 520 | 60 | 100 | 24 | 100 | 3 | 150 | 8 |
| Sample A2 | 577 | 6 | 520 | 60 | 100 | 24 | 100 | 3 | 150 | 8 |
| Sample A3 | 550 | 1 | 520 | 60 | 100 | 24 | 100 | 3 | 150 | 8 |
| Sample A4 | 550 | 24 | 520 | 60 | 100 | 24 | 100 | 3 | 150 | 8 |
| Sample A5 | 550 | 6 | 440 | 60 | 100 | 24 | 100 | 3 | 150 | 8 |
| Sample A6 | 550 | 6 | 560 | 60 | 100 | 24 | 100 | 3 | 150 | 8 |
| Sample A7 | 550 | 6 | 520 | 1 | 100 | 24 | 100 | 3 | 150 | 8 |
| Sample A8 | 550 | 6 | 520 | 300 | 100 | 24 | 100 | 3 | 150 | 8 |
| Sample A9 | 550 | 6 | 520 | 60 | 150 | 24 | 100 | 3 | 150 | 8 |
| Sample A10 | 550 | 6 | 520 | 60 | 100 | — | 100 | 3 | 150 | 8 |
| Sample A11 | 550 | 6 | 520 | 60 | 100 | 240 | 100 | 3 | 150 | 8 |
| Sample A12 | 550 | 6 | 520 | 60 | 100 | 24 | 80 | 5 | 150 | 8 |

TABLE 5-continued

| | Homogenization Treatment | | Hot Working Extruding | Quenching Treatment | | Room-Temp. Aging | First Artificial Aging | | Second Artificial Aging | |
|---|---|---|---|---|---|---|---|---|---|---|
| | Temp. (° C.) | Time (h) | Temp. (° C.) | Cooling Rate (° C./s) | Temp. When Completed (° C.) | Time (h) | Temp. (° C.) | Time (h) | Temp. (° C.) | Time (h) |
| Sample A13 | 550 | 6 | 520 | 60 | 100 | 24 | 120 | 1 | 150 | 8 |
| Sample A14 | 550 | 6 | 520 | 60 | 100 | 24 | 100 | 3 | 145 | 15 |
| Sample A15 | 550 | 6 | 520 | 60 | 100 | 24 | 100 | 3 | 200 | 2 |
| Sample A16 | 550 | 6 | 520 | 60 | 100 | 24 | 145 | 15 | — | |
| Sample A17 | 550 | 6 | 520 | 60 | 100 | 24 | 170 | 2 | — | |

TABLE 6

| | Homogenization Treatment | | Hot Working Extruding | Quenching Treatment | | Room-Temp. Aging | First Artificial Aging | | Second Artificial Aging | |
|---|---|---|---|---|---|---|---|---|---|---|
| | Temp. (° C.) | Time (h) | Temp. (° C.) | Cooling Rate (° C./s) | Temp. When Completed (° C.) | Time (h) | Temp. (° C.) | Time (h) | Temp. (° C.) | Time (h) |
| Sample A18 | 535 | 6 | 520 | 60 | 100 | 24 | 100 | 4 | 150 | 8 |
| Sample A19 | 550 | 0.25 | 520 | 60 | 100 | 24 | 100 | 4 | 150 | 8 |
| Sample A20 | 550 | 6 | 570 | Treatment not possible because of hot-working cracks | | | | | | |
| Sample A21 | 550 | 6 | 520 | 0.25 | 100 | 24 | 100 | 4 | 150 | 8 |
| Sample A22 | 550 | 6 | 520 | 60 | 100 | 24 | 80 | 3 | 140 | 26 |
| Sample A23 | 550 | 6 | 520 | 60 | 100 | 24 | 120 | 5 | 210 | 2 |
| Sample A24 | 550 | 6 | 520 | 60 | 100 | 24 | 100 | 4 | 145 | 1 |
| Sample A25 | 550 | 6 | 520 | 60 | 100 | 24 | 100 | 4 | 200 | 16 |
| Sample A26 | 550 | 6 | 520 | 60 | 100 | 24 | 140 | 23 | — | |
| Sample A27 | 550 | 6 | 520 | 60 | 100 | 24 | 180 | 2 | — | |
| Sample A28 | 550 | 6 | 520 | 60 | 100 | 24 | 165 | 0.25 | — | |
| Sample A29 | 550 | 6 | 520 | 60 | 100 | 24 | 165 | 30 | — | |

The evaluation results of the samples prepared as described above are listed in Table 7. Furthermore, those evaluation results in Table 7 not judged to be acceptable or not judged to be a preferable result are underlined.

TABLE 7

| | Tension Test | | | Metallographic Structure Observation | | Appearance-Characteristics Evaluation | | |
|---|---|---|---|---|---|---|---|---|
| | Tensile Strength (MPa) | Proof Stress (Mpa) | Elongation (%) | Average Crystal Grain Diameter (μm) | Aspect Ratio | Visual Observation | Gloss Value | Conductivity (% IACS) |
| Sample A1 | 407 | 398 | 19 | 130 | 1.3 | Acceptable | 625 | 38.6 |
| Sample A2 | 431 | 416 | 20 | 115 | 1.2 | Acceptable | 636 | 38.5 |
| Sample A3 | 406 | 395 | 20 | 125 | 1.2 | Acceptable | 620 | 38.5 |
| Sample A4 | 428 | 410 | 19 | 100 | 1.1 | Acceptable | 638 | 38.7 |
| Sample A5 | 385 | 370 | 22 | 110 | 1.3 | Acceptable | 605 | 40.1 |
| Sample A6 | 435 | 417 | 19 | 105 | 1.1 | Acceptable | 638 | 38 |

TABLE 7-continued

| | Tension Test | | | Metallographic Structure Observation | | Appearance-Characteristics Evaluation | | |
|---|---|---|---|---|---|---|---|---|
| | Tensile Strength (MPa) | Proof Stress (Mpa) | Elongation (%) | Average Crystal Grain Diameter (μm) | Aspect Ratio | Visual Observation | Gloss Value | Conductivity (% IACS) |
| Sample A7 | 381 | 370 | 18 | 110 | 1.1 | Acceptable | 604 | 40.3 |
| Sample A8 | 438 | 421 | 19 | 110 | 1.3 | Acceptable | 638 | 38 |
| Sample A9 | 388 | 372 | 19 | 120 | 1.2 | Acceptable | 615 | 39.3 |
| Sample A10 | 380 | 370 | 19 | 115 | 1.1 | Acceptable | 630 | 39.1 |
| Sample A11 | 426 | 407 | 21 | 110 | 1.2 | Acceptable | 631 | 38.3 |
| Sample A12 | 411 | 396 | 21 | 110 | 1.2 | Acceptable | 633 | 38.5 |
| Sample A13 | 418 | 402 | 19 | 115 | 1.1 | Acceptable | 630 | 38.3 |
| Sample A14 | 429 | 408 | 20 | 105 | 1.2 | Acceptable | 633 | 38.1 |
| Sample A15 | 391 | 373 | 21 | 120 | 1.3 | Acceptable | 615 | 39.2 |
| Sample A16 | 398 | 371 | 19 | 125 | 1.1 | Acceptable | 632 | 38.2 |
| Sample A17 | 401 | 382 | 20 | 105 | 1.1 | Acceptable | 618 | 39.3 |
| Sample A18 | 389 | 371 | 22 | 130 | 2.3 | Unacceptable | 615 | 38.7 |
| Sample A19 | 391 | 375 | 21 | 125 | 1.6 | Unacceptable | 613 | 38.6 |
| Sample A20 | Evaluation not possible because of hot-working cracks | | | | | | | |
| Sample A21 | 365 | 336 | 22 | 120 | 1.1 | Acceptable | 566 | 40.3 |
| Sample A22 | 379 | 350 | 19 | 110 | 1.1 | Acceptable | 621 | 38.6 |
| Sample A23 | 379 | 345 | 23 | 110 | 1.3 | Acceptable | 617 | 38.5 |
| Sample A24 | 374 | 348 | 21 | 125 | 1.2 | Acceptable | 623 | 37.4 |
| Sample A25 | 376 | 351 | 20 | 115 | 1.1 | Acceptable | 609 | 40.3 |
| Sample A26 | 379 | 356 | 18 | 120 | 1.3 | Acceptable | 624 | 37.8 |
| Sample A27 | 377 | 359 | 22 | 105 | 1.1 | Acceptable | 609 | 38.5 |
| Sample A28 | 376 | 359 | 22 | 110 | 1.2 | Acceptable | 622 | 37.4 |
| Sample A29 | 375 | 354 | 21 | 115 | 1.3 | Acceptable | 608 | 40 |

As can be understood from Table 7, samples A1-A17 were acceptable for all evaluation items and exhibited both excellent strength properties and appearance characteristics.

In sample A18, the heating temperature in the homogenization treatment was too low, and consequently streak patterns were visually confirmed on the surface and were judged to be unacceptable.

In sample A19, the treatment time in the homogenization treatment was too short, and consequently streak patterns were visually confirmed on the surface and were judged to be unacceptable.

In sample A20, the heating temperature of the ingot, before the hot extrusion, was too high, and consequently the ingot partially melted during the extrusion; as a result, hot-working cracks formed and therefore treatments subsequent to the quenching treatment could not be performed.

In sample A21, the average cooling rate in the quenching treatment was too low, and consequently the tensile strength was insufficient. In addition, in sample A21, the gloss value was insufficient. Consequently, in sample A21, the tensile strength and the appearance characteristics were insufficient and were judged to be unacceptable.

In sample A22, the treatment temperature in the second artificial-aging treatment was too low, and consequently the tensile strength was insufficient and was judged to be unacceptable.

In sample A23, the treatment temperature in the second artificial-aging treatment was too high and the sample was over-aged; as a result, the tensile strength was insufficient and was judged to be unacceptable.

In sample A24, the treatment time in the second artificial-aging treatment was too short and therefore age hardening was insufficient; as a result, the tensile strength was insufficient and was judged to be unacceptable.

In sample A25, the treatment time in the second artificial-aging treatment was too long and therefore the sample was over-aged; as a result, the tensile strength was insufficient and was judged to be unacceptable.

In sample A26, only one stage of the artificial-aging treatment was performed, but the treatment temperature in the artificial-aging treatment was too low and therefore the age hardening was insufficient; as a result, the tensile strength was insufficient and was judged to be unacceptable.

In sample A27, the treatment temperature in the artificial-aging treatment of just the first stage was too high, and therefore the sample was over-aged; as a result, the tensile strength was insufficient and was judged to be unacceptable.

In sample A28, the treatment time in the artificial-aging treatment of just the first stage was too short, and therefore the age hardening was insufficient; as a result, the tensile strength was insufficient and was judged to be unacceptable.

In sample A29, the treatment time in the artificial-aging treatment of just the first stage was too long, and therefore the sample was over-aged; as a result, the tensile strength was insufficient and was judged to be unacceptable.

The invention claimed is:

1. An aluminum alloy, comprising in mass percent:
Zn: 2.5% or more and less than 5.0%,
Mg: 2.2% or more and 3.0% or less,
Ti: 0.001% or more and 0.05% or less,
Cu: 0.10% or less,
Zr: 0.10% or less,
Cr: 0.03% or less,
Fe: 0.30% or less,
Si: 0.30% or less, and
Mn: 0.03% or less,
the remainder being composed of Al and unavoidable impurities,
wherein the aluminum alloy has:
a tensile strength of 380 MPa or more;
an electrical conductivity of 38.0% IACS or more; and
a metallographic structure composed of a recrystallized structure.

2. The aluminum alloy according to claim 1, wherein:
the recrystallized structure includes crystal grains having an average grain diameter of 500 μm or less, and
a crystal grain length in a direction parallel to a hot working direction is 0.5 to 4 times as long as a crystal grain length in a direction perpendicular to the hot working direction.

3. The aluminum alloy according to claim 2, wherein Zn is 2.5% or more and 4.8% or less.

4. The aluminum alloy according to claim 3, wherein the aluminum alloy has an anodized surface that has a gloss value of 600 or more as measured according to ISO 7668 with an angle of incidence of a light beam set to 60°.

5. The aluminum alloy according to claim 1, wherein Zn is 2.5% or more and 4.8% or less.

6. The aluminum alloy according to claim 1, wherein the aluminum alloy has an anodized surface that has a gloss value of 600 or more as measured according to ISO 7668 with an angle of incidence of a light beam set to 60°.

7. A process for producing a wrought aluminum alloy material, which comprises:
preparing an ingot having a chemical composition comprising, in mass percent, Zn: 2. 5% or more and less than 5.0%, Mg: 2.2% or more and 3.0% or less, Ti: 0.001% or more and 0.05% or less, Cu: 0.10% or less, Zr: 0.10% or less, Cr: 0.03% or less, Fe: 0.30% or less, Si: 0. 30% or less, and Mn: 0.03% or less, the remainder being composed of Al and unavoidable impurities,
performing a homogenization treatment that heats the ingot at a temperature of 540° C. or higher and 580° C. or lower for 1 hour to 24 hours;
subsequently, forming a wrought material by performing hot working on the ingot in a state where the temperature of the ingot at the beginning of the working is 440° C. to 560° C.;
while the wrought material is still at 400° C. or higher, starting to cool it and subsequently performing a quenching treatment such that, while the wrought material is cooling down from 400° C. to 150° C., the average cooling rate is 3° C./s or more and 300° C./s or less;
cooling the temperature of the wrought material to room temperature by said quenching treatment or by an additional cooling treatment; and
thereafter, performing an artificial aging treatment on the wrought material.

8. The process according to claim 7, wherein the artificial aging treatment comprises performing a first artificial aging treatment at a temperature of 80° C. to 120° C. for 1 hour to 5 hours, and continuously after the first artificial aging treatment, performing a second artificial aging treatment that heats the wrought material at a temperature of 145° C. to 200° C. for 2 hours to 15 hours.

9. The process according to claim 8, wherein the second artificial aging treatment is performed at a temperature of 170° C. to 200° C.

10. The process according to claim 8, wherein:
the homogenization treatment is performed at 555° C. for 5 hours,
the hot working comprises hot extruding the ingot while the temperature of the ingot is at 520° C.,
the quenching treatment is initiated while the temperature of the wrought material is at 510° C. and the average cooling rate of the quenching treatment is 60° C./sec, thereafter the wrought material is subjected to room temperature aging for 48 hours,
the first artificial aging treatment involves heating the wrought material at 100° C. for 3 hours, and
the second artificial aging treatment involves heating the wrought material at 150° C. for 8 hours.

11. The process according to claim 10, further comprising anodizing the wrought material after the second artificial aging treatment.

12. The process according to claim 7, wherein the artificial aging treatment comprises heating the wrought material at a temperature of 145° C. to 180° C. for 1 hour to 24 hours.

13. The process according to claim 7, wherein the hot working involves extrusion or rolling.

14. The process according to claim 7, further comprising anodizing the wrought material after the artificial aging treatment.

15. The process according to claim 7, wherein the homogenization treatment is performed at a temperature of more than 540° C. and 580° C. or lower for 1 hour to 24 hours.

16. A process for producing the aluminum alloy of claim 1, comprising:
homogenizing an ingot having the elemental composition recited in claim 1 at a temperature of 540° C. or higher and 580° C. for at least 1 hour;
hot working on the homogenized ingot while the temperature of the ingot at the beginning of the hot working is 440° C. to 560° C., thereby forming a wrought material, while the wrought material is still at 400° C. or higher, starting to cool it and subsequently performing a quenching treatment such that, while the wrought material is cooling down from 400° C. to 150° C., the average cooling rate is 1° C./s or more and 300° C./s or less;

cooling the temperature of the wrought material to room temperature by said quenching treatment or by an additional cooling treatment; and thereafter, performing an artificial aging treatment on the wrought material.

17. The process according to claim 16, wherein the artificial aging treatment comprises performing a first artificial aging treatment at a temperature of 80° C. to 120° C. for 1 hour to 5 hours, and continuously after the first artificial aging treatment, performing a second artificial aging treatment that heats the wrought material at a temperature of 145° C. to 200° C. for 2 hours to 15 hours.

18. The process according to claim 16, wherein the artificial aging treatment comprises heating the wrought material at a temperature of 145° C. to 180° C. for 1 hour to 24 hours.

19. The process according to claim 16, wherein the homogenization treatment is performed at a temperature of more than 540° C. and 580° C. or lower for 1 hour to 24 hours.

* * * * *